US009548526B2

(12) United States Patent
Lu et al.

(10) Patent No.: US 9,548,526 B2
(45) Date of Patent: Jan. 17, 2017

(54) SMALL-SIZE ANTENNA SYSTEM WITH ADJUSTABLE POLARIZATION

(71) Applicant: HTC Corporation, Taoyuan, Taoyuan County (TW)

(72) Inventors: Hsin-Chia Lu, Taoyuan (TW); Pei-Zong Rao, Taoyuan (TW); Siang-Yu Siao, Taoyuan (TW); Wei-Shin Tung, Taoyuan (TW)

(73) Assignee: HTC Corporation, Taoyuan (TW)

( * ) Notice: Subject to any disclaimer, the term of this patent is extended or adjusted under 35 U.S.C. 154(b) by 202 days.

(21) Appl. No.: 14/073,430

(22) Filed: Nov. 6, 2013

(65) Prior Publication Data

US 2014/0176389 A1 Jun. 26, 2014

Related U.S. Application Data

(60) Provisional application No. 61/745,197, filed on Dec. 21, 2012.

(51) Int. Cl.
*H01Q 15/24* (2006.01)
*H01Q 1/24* (2006.01)
(Continued)

(52) U.S. Cl.
CPC ..... *H01Q 1/243* (2013.01); *H01Q 9/045* (2013.01); *H01Q 9/0435* (2013.01); *H01Q 21/245* (2013.01)

(58) Field of Classification Search
CPC ..... H01Q 15/24; H01Q 1/243; H01Q 9/0435; H01Q 9/045; H01Q 21/245; H01Q 5/385; H01Q 5/392; H01Q 5/378
(Continued)

(56) References Cited

U.S. PATENT DOCUMENTS 4,127,831 A * 11/1978 Riblet ..... H01P 5/18 333/113
4,823,097 A * 4/1989 Konishi ..... H01P 5/187 333/116
(Continued)

FOREIGN PATENT DOCUMENTS

CN 101242027 A 8/2008
CN 201673999 U 12/2010
EP 0431764 B1 * 3/1997 ..... H01Q 21/20

OTHER PUBLICATIONS

Rodney B. Waterhouse, Microstrip Patch Antennas: A Designers Guide, 1st Edition 2003, pp. 232 and 356.*
(Continued)

*Primary Examiner* — Dieu H Duong
*Assistant Examiner* — Bamidele A Jegede
(74) *Attorney, Agent, or Firm* — Birch, Stewart, Kolasch & Birch, LLP

(57) ABSTRACT

An antenna system includes a ground plane, a microstrip-line coupler, a metal cover, and a main antenna. The microstrip-line coupler has a first input port, a second input port, a first output port, and a second output port. The metal cover is disposed above the microstrip-line coupler and coupled to the ground plane. The main antenna is coupled to the first output port and the second output port of the microstrip-line coupler. The metal cover is configured to reduce the interference from the microstrip-line coupler and to enhance the gain of the main antenna.

8 Claims, 4 Drawing Sheets

(51) Int. Cl.
*H01Q 9/04* (2006.01)
*H01Q 21/24* (2006.01)

(58) Field of Classification Search
USPC ..... 343/872
See application file for complete search history.

(56) References Cited

U.S. PATENT DOCUMENTS

| | | | | |
|---|---|---|---|---|
| 4,866,451 | A * | 9/1989 | Chen | H01Q 21/065 343/700 MS |
| 5,061,939 | A * | 10/1991 | Nakase | 343/700 MS |
| 5,172,128 | A | 12/1992 | Bouko et al. | |
| 5,291,210 | A * | 3/1994 | Nakase | H01Q 9/40 343/700 MS |
| 5,929,729 | A * | 7/1999 | Swarup | H01P 3/085 333/116 |
| 5,955,994 | A * | 9/1999 | Staker et al. | 343/700 MS |
| 6,104,348 | A * | 8/2000 | Karlsson et al. | 343/700 MS |
| 6,445,346 | B2 * | 9/2002 | Fathy et al. | 343/700 MS |
| 7,405,701 | B2 * | 7/2008 | Ozkar | 343/702 |
| 8,334,810 | B2 * | 12/2012 | Foo | 343/700 MS |
| 2004/0257292 | A1 | 12/2004 | Wang | |
| 2008/0238793 | A1 * | 10/2008 | Channabasappa | H01Q 9/0457 343/767 |

OTHER PUBLICATIONS

Bhatti et al. Compact Antenna Array with POrt Decoupling for LTE-Standardized Mobile Phone, IEEE Antenna and Wireless Propagation Letters, vol. 8, 2009, pp. 1430-1433.*

* cited by examiner

SMALL-SIZE ANTENNA SYSTEM WITH ADJUSTABLE POLARIZATION

CROSS REFERENCE TO RELATED APPLICATIONS

This application claims the benefit of U.S. Provisional Application No. 61/745,197, filed on Dec. 21, 2012, the entirety of which is incorporated by reference herein.

BACKGROUND OF THE INVENTION

Field of the Invention

The subject application generally relates to an antenna system, and more specifically, relates to an antenna system for use in a mobile communication device.

Description of the Related Art

In a communication system, if a transmission antenna and a reception antenna have different polarization directions, the transmission efficiency may be negatively affected very much. For example, if the transmission antenna is horizontally-polarized, the reception antenna should be also horizontally-polarized to achieve the maximum transmission efficiency. Otherwise, a vertically-polarized reception antenna may not receive any horizontally-polarized signal at all. Also, if the transmission antenna is RHCP (Right-Hand Circularly-Polarized), the reception antenna should be also RHCP to achieve the maximum transmission efficiency. Otherwise, an LHCP (Left-Hand Circularly-Polarized) reception antenna may not receive any RHCP signal at all.

When the communication system is applied to video streaming, gaming or data transfer, the transmission data should be compressed due to there being no sufficient transmission bandwidth. However, the compressed data have some disadvantages, for example, distortion, low quality, transmission delay, and package loss, etc. For uncompressed video transmission at low frequency (e.g., 5 GHz), such as through WHDI (Wireless Home Digital Interface), it requires at least four antennas to transmit a 1080P video. This design is too large to be used in a cellular phone. Accordingly, how to design a small antenna with adjustable polarization is a critical challenge for current antenna designers.

BRIEF SUMMARY OF THE INVENTION

In one exemplary embodiment, the subject application is directed to an antenna system, comprising: a ground plane; a microstrip-line coupler, having a first input port, a second input port, a first output port, and a second output port; a metal cover, disposed above the microstrip-line coupler, and coupled to the ground plane; and a main antenna, coupled to the first output port and the second output port of the microstrip-line coupler.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1A:
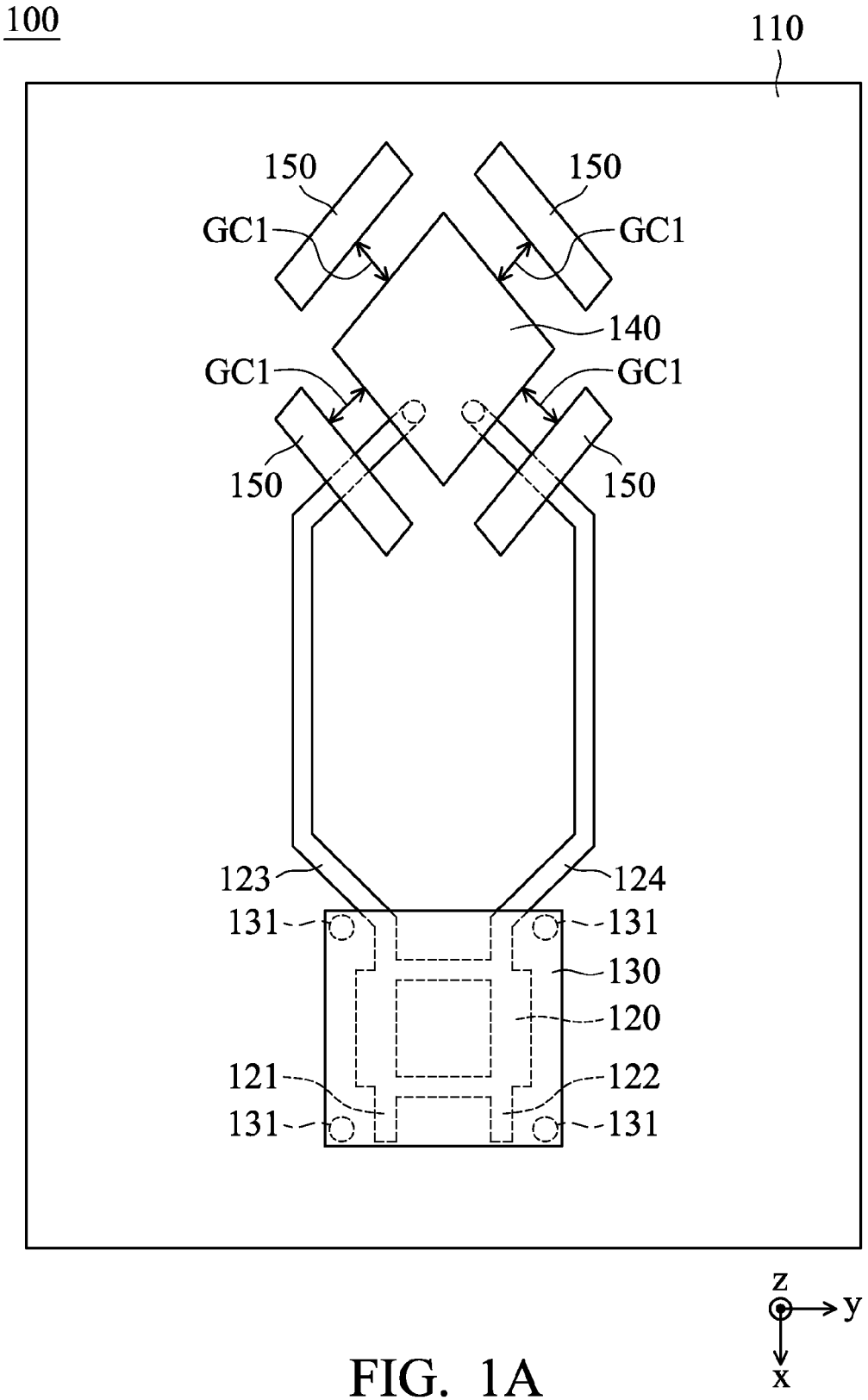
FIG. 1A is a top view for illustrating an antenna system according to an embodiment of the invention.
Figure 1B:
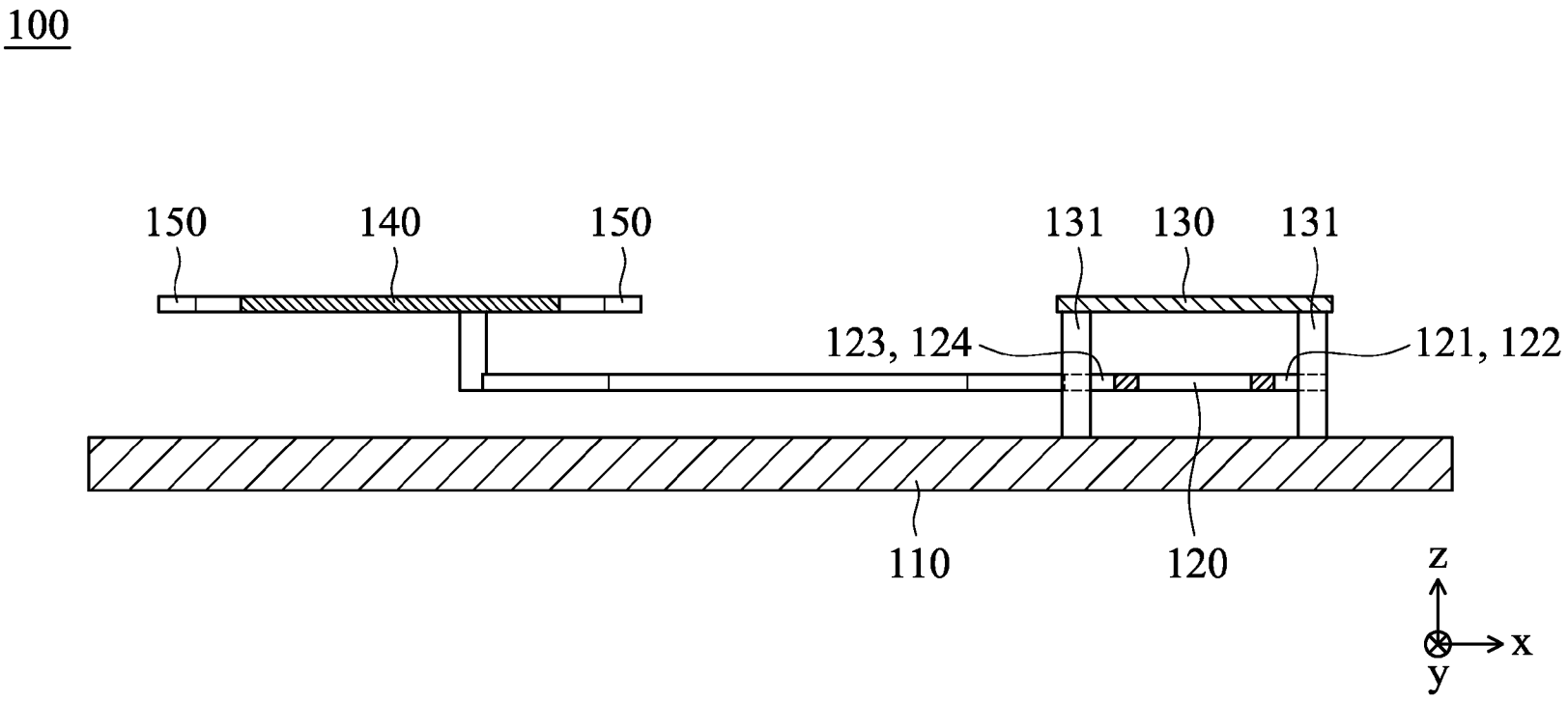
FIG. 1B is a side view for illustrating an antenna system according to an embodiment of the invention.

FIG. 1A is a top view for illustrating an antenna system 100 according to an embodiment of the invention. FIG. 1B is a side view for illustrating the antenna system 100 according to an embodiment of the invention. The antenna system 100 may be applied to a mobile communication device, such as a smart phone, a tablet computer, or a notebook computer. In a preferred embodiment, the antenna system 100 at least comprises a ground plane 110, a microstrip-line coupler 120, a metal cover 130, and a main antenna 140. The ground plane 110 may be disposed on a dielectric substrate (not shown), such as an FR4 (Flame Retardant 4) substrate or an LTCC (Low Temperature Co-fired Ceramic) substrate. In some embodiments, the mobile communication device with the antenna system 100 further comprises other components, such as a processor, a touch-control module, a display module, a battery, an RF (Radio Frequency) module, and a housing (not shown).

Figure 2A:
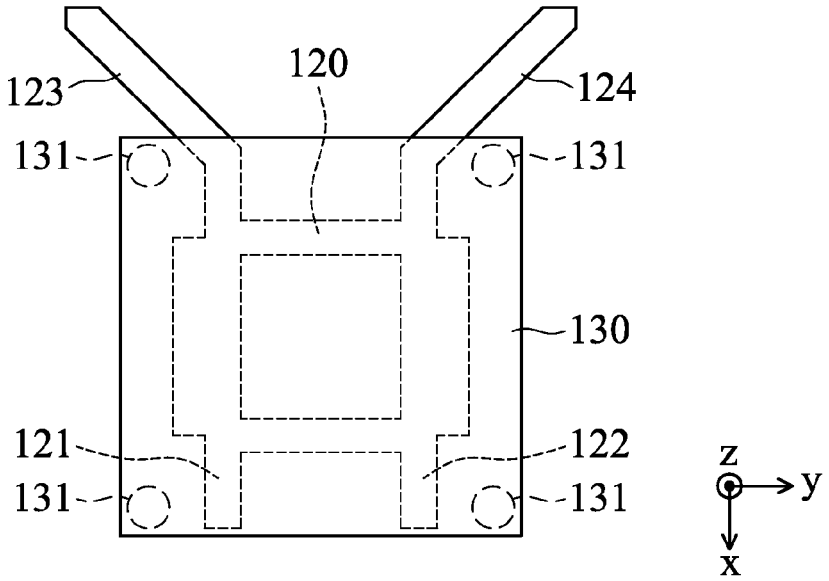
FIG. 2A is a top view for illustrating a microstrip-line coupler and a metal cover according to an embodiment of the invention.
Figure 2B:
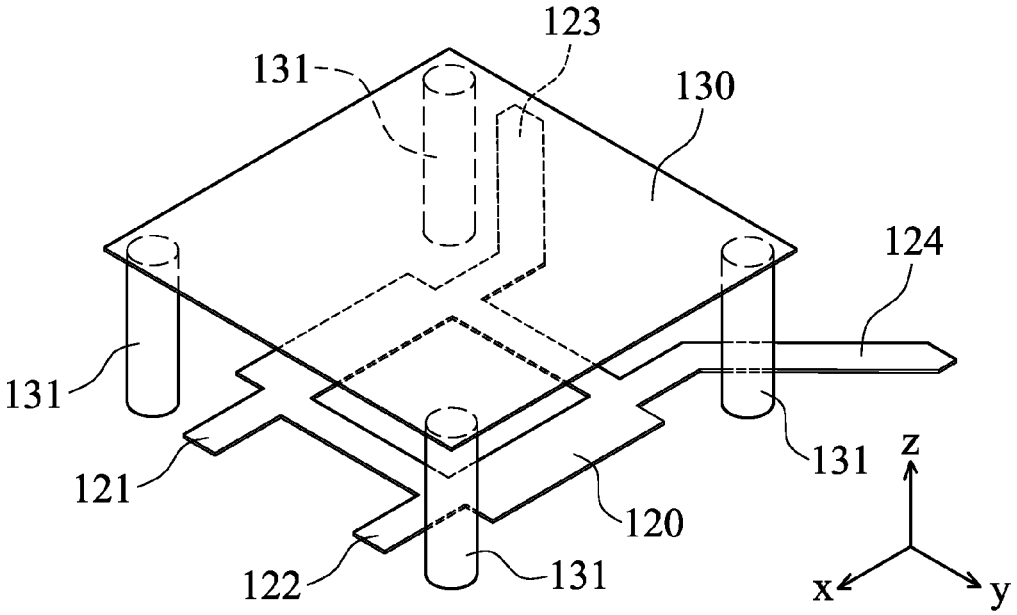
FIG. 2B is a perspective view for illustrating a microstrip-line coupler and a metal cover according to an embodiment of the invention.

FIG. 2A is a top view for illustrating the microstrip-line coupler 120 and the metal cover 130 according to an embodiment of the invention. FIG. 2B is a perspective view for illustrating the microstrip-line coupler 120 and the metal cover 130 according to an embodiment of the invention. Please refer to FIGS. 1A, 1B, 2A, and 2B together. The microstrip-line coupler 120 has a first input port 121, a second input port 122, a first output port 123, and a second output port 124. The first input port 121 and the second input port 122 of the microstrip-line coupler 120 are coupled to a signal source (not shown), such as the RF module of the mobile communication device. The first output port 123 and the second output port 124 of the microstrip-line coupler 120 are coupled to the main antenna 140 and configured to excite the main antenna 140. In some embodiments, the microstrip-line coupler 120 is a 90° branch-line coupler. More specifically, the 90° branch-line coupler comprises four transmission lines coupled to each other. The transmission lines may form a hollow square shape, and the length of each transmission line may be substantially equal to 0.25 wavelength of the central operation frequency of the main antenna 140. The polarization of the main antenna 140 may be adjusted by changing the feeding phase difference between the first input port 121 and the second input port 122 of the microstrip-line coupler 120. The detailed method for adjustments will be described in the following embodiments.

The metal cover 130 is disposed above the microstrip-line coupler 120 and is coupled to the ground plane 110. The metal cover 130 may substantially have a square shape, but it is not limited thereto. For example, adjustments may be made such that the metal cover 130 has a circular shape, an equilateral triangular shape, or a regular hexagonal shape. In some embodiments, the antenna system 100 further comprises a plurality of shorting vias 131. The metal cover 130 is coupled through the shorting vias 131 to the ground plane 110. For example, the number of shorting vias 131 may be 4, and the shorting vias 131 may be respectively coupled to corners of the metal cover 130. More specifically, the metal cover 130 has a first vertical projection on the ground plane 110, the microstrip-line coupler 120 has a second vertical projection on the ground plane 110, and the whole second vertical projection is inside the first vertical projection. The metal cover 130 is configured to prevent the radiating interference from the microstrip-line coupler 120 against the antenna system 100, and to further enhance the gain of the main antenna 140. The detailed operation and theory of the metal cover 130 will be described in the following embodiments.

The main antenna 140 may be a dual-feeding patch antenna, which may substantially have a rectangular shape. The main antenna 140 may operate and have different polarization directions by adjusting the feeding phase difference between two feeding points of the main antenna 140. In some embodiments, the antenna system 100 further comprises a plurality of parasitic elements 150 disposed adjacent to the main antenna 140. For example, the number of parasitic elements 150 may be 4, and each parasitic element 150 may substantially have a straight-line shape. The parasitic elements 150 are separated from the main antenna 140, and the main antenna 140 is substantially surrounded by the parasitic elements 150. In some embodiments, a respective coupling gap GC1 is formed between each parasitic element 150 and the main antenna 140, and the width of the coupling gap GC1 is smaller than 1 mm. The parasitic elements 150 are configured to increase the bandwidth of the main antenna 140 due to the mutual coupling effect therebetween. Note that the parasitic elements 150 are optional components of the antenna system 100, and they may be omitted in other embodiments.

Figure 3A:
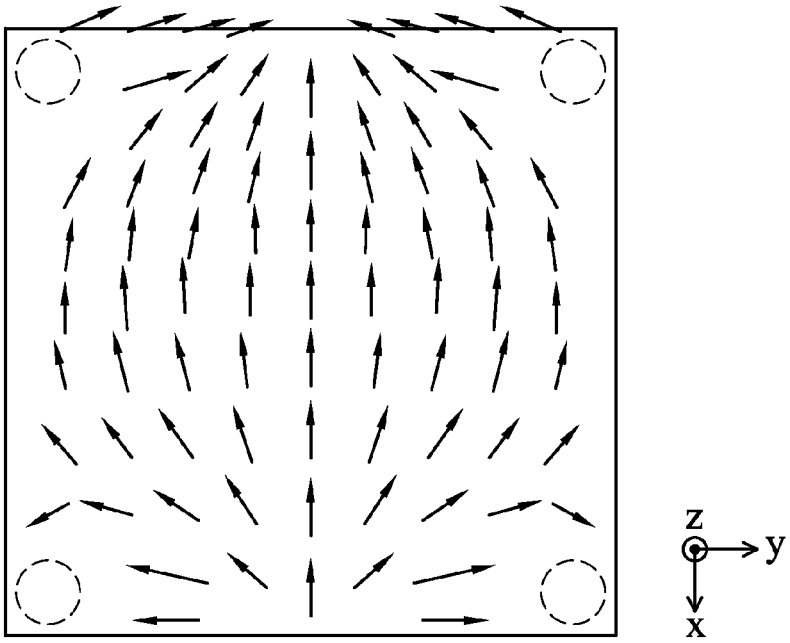
FIG. 3A is a top view for illustrating current distribution of a metal cover when a main antenna is excited, according to an embodiment of the invention.

FIG. 3A is a top view for illustrating current distribution of the metal cover 130 when the main antenna 140 is excited, according to an embodiment of the invention. The displayed arrows represent surface currents. In the embodiment of FIG. 3A, the microstrip-line coupler 120 is driven in phase. That is, the feeding phase difference between the first input port 121 and the second input port 122 of the microstrip-line coupler 120 is equal to 0 degree. In such a case, the direction of the surface currents on the main antenna 140 is substantially parallel to the x-axis, and the direction of the surface currents on the metal cover 130 is also substantially parallel to the x-axis.

Figure 3B:
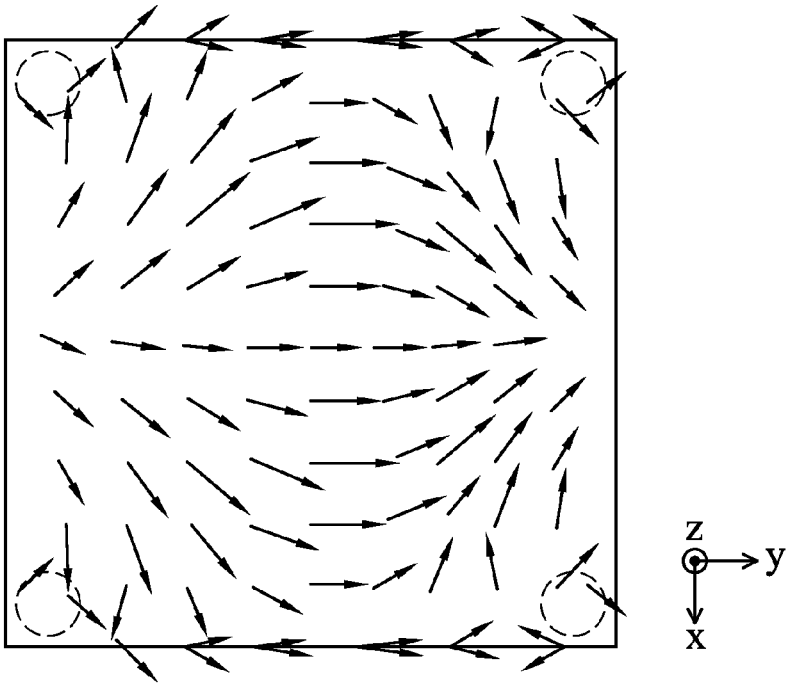
FIG. 3B is a top view for illustrating current distribution of a metal cover when a main antenna is excited, according to another embodiment of the invention.

FIG. 3B is a top view for illustrating current distribution of the metal cover 130 when the main antenna 140 is excited, according to another embodiment of the invention. The displayed arrows represent surface currents. In the embodiment of FIG. 3B, the microstrip-line coupler 120 is driven out of phase. That is, the feeding phase difference between the first input port 121 and the second input port 122 of the micro strip-line coupler 120 is equal to 180 degrees. In such a case, the direction of the surface currents on the main antenna 140 is substantially parallel to the y-axis, and the direction of the surface currents on the metal cover 130 is also substantially parallel to the y-axis.

As shown in FIGS. 3A and 3B, the current directions of the metal cover 130 and the main antenna 140 may be adjusted by changing the feeding phase difference between the first input port 121 and the second input port 122 of the micro strip-line coupler 120. Therefore, it is easy to control the antenna system 100 of the invention to generate a variety of polarization directions, thereby receiving or transmitting signals in different polarization directions. It is understood that the invention is not limited to the above. In other embodiments, the signal phases of the first input port 121 and the second input port 122 of the microstrip-line coupler 120 may be set according to Table I and Table II as follows (in which, "(X)" represents no signal being input/output to/from the corresponding port).

TABLE I

Signal phase of microstrip-line coupler 120

| | First setting | Second setting | Third setting | Fourth setting |
|---|---|---|---|---|
| First input port 121 | 135° | 360° | 270° | 90° |
| Second input port 122 | 135° | 270° | 360° | 270° |
| First output port 123 | 0° | (X) | 180° | 45° |
| Second output port 124 | 0° | 180° | (X) | −135° |
| Polarization of antenna system 100 | Linear polarization parallel to x-axis | Linear polarization parallel to straight line "x = y" | Linear polarization parallel to straight line "x = −y" | Linear polarization parallel to y-axis |

TABLE II

Signal phase of microstrip-line coupler 120

| | Fifth setting | Sixth setting |
|---|---|---|
| First input port 121 | 180° | (X) |
| Second input port 122 | (X) | 180° |
| First output port 123 | 90° | 0° |
| Second output port 124 | 0° | 90° |
| Polarization of antenna system 100 | RHCP | LHCP |

According to a measurement result, when the main antenna 140 is excited, the metal cover 130 is also excited by the microstrip-line coupler 120 due to the mutual coupling effect, and the polarization direction of the induced surface currents on the metal cover 130 is substantially the same as the polarization direction of the surface currents on the main antenna 140. As a result, the metal cover 130 is considered as another auxiliary antenna of the antenna system 100. That is, an antenna array is formed by both the metal cover 130 and the main antenna 140, and the gain of the antenna array is substantially equal to the summary gain of the metal cover 130 and the main antenna 140. According to the measurement result, the total gain, the total directivity, and the antenna bandwidth of the antenna system 100 are significantly enhanced after the metal cover 130 is included.

In addition, when the main antenna 140 is excited, the direction of the surface currents on the metal cover 130 is substantially opposite to the direction of the surface currents on the microstrip-line coupler 120. It is understood that the microstrip-line coupler 120 generally does not radiate in low frequency bands but radiates in high frequency bands. In high frequency bands, the radiation from the microstrip-line coupler 120 generally destructively interferes with the radiation from the main antenna 140, and the performance of the main antenna 140 is degraded accordingly. After the metal cover 130 is included, the currents induced from the microstrip-line coupler 120 on the metal cover 130 are opposite to the currents on the microstrip-line coupler 120 itself, and therefore the opposite currents on the metal cover 130 can offset the undesired radiation from the microstrip-line coupler 120, such that the antenna efficiency of the main antenna 140 is improved.

In a preferred embodiment, the antenna system 100 of the invention operates in about a 60 GHz frequency band. Since the antenna array composed of the metal cover 130 and the main antenna 140 can provide sufficient bandwidth, a mobile communication device with the antenna system 100 can directly transmit a large amount of data to a receiver (e.g., a television or any display device) without any data compression procedure. In comparison to the prior art, the antenna system 100 of the invention at least has the advantages of reducing size, providing adjustable polarization, increasing transmission speed, and improving the quality of data transmission.

Note that the above element sizes, element parameters, element shapes, and frequency ranges are just exemplary and not limitations of the invention. These settings or values may be adjusted by an antenna designer according to different requirements. In addition, the antenna system of the invention is not limited to the configurations of FIGS. 1A, 1B, 2A, 2B, 3A, and 3B. The invention may merely include any one or more features of any one or more embodiments of FIGS. 1A, 1B, 2A, 2B, 3A, and 3B. In other words, not all of the displayed features in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for ordinal term) to distinguish the claim elements.

The embodiments of the disclosure are considered as exemplary only, not limitations. It will be apparent to those skilled in the art that various modifications and variations can be made in the invention. The true scope of the disclosed embodiments being indicated by the following claims and their equivalents.

What is claimed is:

1. An antenna system, comprising:

a ground plane;

a microstrip-line coupler, having a first input port, a second input port, a first output port, and a second output port;

a metal cover, disposed above the microstrip-line coupler, and coupled to the ground plane; and a main antenna, coupled to the first output port and the second output port of the microstrip-line coupler, wherein the metal cover is configured to reduce interference from the microstrip-line coupler and to enhance gain of the main antenna, wherein the metal cover has a first vertical projection on the ground plane, the microstrip-line coupler has a second vertical projection on the ground plane, and the whole second vertical projection is inside the first vertical projection, wherein the main antenna is a dual-feeding patch antenna which has a rectangular shape, and the first output port and the second output port are respectively coupled to two adjacent edges of the rectangular shape, and wherein the antenna system further comprises four shorting vias, wherein the metal cover substantially has a square shape, and wherein four corners of the metal cover are respectively coupled through the four shorting vias to the ground plane.

2. The antenna system as claimed in claim 1, wherein when the main antenna is excited, direction of surface currents on the metal cover is substantially the same as direction of surface currents on the main antenna, such that an antenna array is formed by the metal cover and the main antenna.

3. The antenna system as claimed in claim 1, wherein when the main antenna is excited, direction of surface currents on the metal cover is substantially opposite to direction of surface currents on the microstrip-line coupler, such that radiation from the microstrip-line coupler is offset.

4. The antenna system as claimed in claim 1, wherein the microstrip-line coupler is a 90° branch-line coupler which comprises four transmission lines coupled to each other, and a length of each transmission line is substantially equal to 0.25 wavelength of a central operation frequency of the main antenna.

5. The antenna system as claimed in claim 1, further comprising:

a plurality of parasitic elements, surrounding the main antenna, wherein the parasitic elements are separated from the main antenna, and a respective coupling gap is formed between each parasitic element and the main antenna.

6. The antenna system as claimed in claim 5, wherein the parasitic elements are configured to increase bandwidth of the main antenna.

7. The antenna system as claimed in claim 1, wherein polarization of the main antenna is adjusted by changing a feeding phase difference between the first input port and the second input port of the microstrip-line coupler.

8. The antenna system as claimed in claim 1, wherein the antenna system operates at about a 60 GHz frequency band.

* * * * *